US007111571B2

(12) United States Patent
Kosomaa et al.

(10) Patent No.: US 7,111,571 B2
(45) Date of Patent: Sep. 26, 2006

(54) ARRANGEMENT IN A MARINE VESSEL

(75) Inventors: Janne Kosomaa, Turku (FI); Mika Laurilehto, Turku (FI); Oskar Levander, Turku (FI)

(73) Assignee: Wartsila Finland Oy, Vaasa (FI)

( * ) Notice: Subject to any disclaimer, the term of this patent is extended or adjusted under 35 U.S.C. 154(b) by 110 days.

(21) Appl. No.: 11/003,880

(22) Filed: Dec. 2, 2004

(65) Prior Publication Data

US 2005/0139976 A1 Jun. 30, 2005

(30) Foreign Application Priority Data

Dec. 15, 2003 (FI) ..... 20031827

(51) Int. Cl.
*B63B 43/00* (2006.01)
*B63B 43/26* (2006.01)
*B63B 3/56* (2006.01)

(52) U.S. Cl. ..... 114/116; 114/78; 114/117; 114/121

(58) Field of Classification Search ..... 114/78, 114/116–125
See application file for complete search history.

(56) References Cited

U.S. PATENT DOCUMENTS 542,169 A * 7/1895 Melville ..... 114/120
1,071,845 A * 9/1913 Wilber ..... 114/118
1,337,060 A * 4/1920 Foerster et al. ..... 114/118
2,979,009 A * 4/1961 Sorman ..... 114/74 R
4,802,306 A 2/1989 Laxo
5,626,092 A * 5/1997 Essen et al. ..... 114/74 R

FOREIGN PATENT DOCUMENTS

| | | |
|---|---|---|
| DE | 37 13 837 | 11/1988 |
| GB | 2841 | 3/1916 |
| GB | 13 030 | 9/1916 |

* cited by examiner

*Primary Examiner*—Ajay Vasudeva
(74) *Attorney, Agent, or Firm*—Smith-Hill and Bedell

(57) ABSTRACT

A marine vessel has at least two engines installed in separate respective engine compartments that are positioned substantially horizontally adjacent to each other and are separated from each other by a wall structure defining at least one opening provided with a floodgate arrangement. The floodgate arrangement includes a gate device that is movable between a closed position, in which the gate device blocks the opening, and an open position, in which the gate device frees the opening, and a buoyancy assisted movement actuation device for moving the gate device from its closed position to its open position under the influence of rising water level.

12 Claims, 3 Drawing Sheets

ARRANGEMENT IN A MARINE VESSEL

BACKGROUND OF THE INVENTION

This invention relates to an arrangement in a marine vessel having at least two engines installed in separate respective engine compartments that are positioned substantially horizontally adjacent to each other.

In construction and operation of a marine vessel, safety is one of the most important factors. There are several factors to consider when gas is used as fuel in the engines of a marine vessel. In connection with gas operated engines safety arrangements are particularly important and are stricter than for example with heavy fuel oil engines. Redundancy of machinery must be at adequate level also. For safety reasons gas operated engines are installed in two (or more) separate engine compartments, and an explosion proof bulkhead is required between the engine compartments. Also gas leakage is a risk, which must be taken into account. In most cases the two engine compartments are horizontally adjacent and are separated by a longitudinal bulkhead. However, a vessel provided with a longitudinal water and gas tight bulkhead is at risk of excessive listing in case of a water leak through board of the vessel. This risk has been minimized by using floodgates or the like in the longitudinal bulkheads. Water that enters one engine compartment may pass to the adjacent engine compartment through the floodgate thus equalizing the weight distribution and preventing excessive listing. A commonly known floodgate structure includes a gate hinged at its upper edge to the opening frame. Should the water level in one engine compartment rise relative to that in the horizontally adjacent engine compartment, the pressure difference between the engine compartments pushes the gate so that it swings open and allows the water levels to equalize.

This kind of a solution has a major drawback particularly when gas engines are used. Thus, in case of explosion in one engine compartment, the effect of the explosion, such as a pressure pulse, is transmitted through the hinged gate to the other engine compartment, due to the gate being operated by pressure difference between the engine compartments.

It is an object of the invention to provide an arrangement that minimizes the shortcomings of the prior art. More specifically it is an object of the invention to provide a floodgate arrangement device that is explosion proof and nevertheless simple in its construction.

SUMMARY OF THE INVENTION

In an arrangement in a marine vessel according to the invention, which vessel has at least two engines installed in separate respective engine compartments positioned substantially horizontally adjacent to each other, the engine compartments are separated from each other by a wall structure comprising at least one opening provided with a floodgate arrangement, and the floodgate arrangement comprises a buoyancy assisted movement actuation device for moving a gate device of the floodgate arrangement under the influence of rising water level. This way the rising water level may open the gate, but not hydrodynamic pressure of water flowing against the gate device.

The buoyancy assisted movement actuation device may comprise a float means in direct connection with the floodgate device. In some cases, depending e.g. on machine room layout, the buoyancy assisted movement actuation device may comprise a float means in force transmission connection with, but separate from, the floodgate arrangement.

The wall structure may comprise a gate support structure adapted to prevent rotational movement of the gate device and to allow translational movement of the gate device. This prevents the opening of the gate device under the influence of increasing pressure in either of the compartments e.g. caused by an explosion. The gate device is supported to the wall structure by gate device guides, which guide the gate device and allow only substantially vertical movement of the gate device.

The wall structure may define a space provided for the gate device into which space the gate device may at least partially move providing a safe cover and clear space for the gate device to move. The floodgate arrangement may comprise pressure device for influencing the pressure prevailing in the space provided for the gate device. With the pressure device, such as a blower, the space may by maintained in an underpressure condition, which prevents gas passing from one compartment to the other in case of a gas leakage.

The float means of the buoyancy assisted movement actuation device is preferably connected with the lower section of the gate device, so that movement of the gate device commences at the earliest possible event.

BRIEF DESCRIPTION OF THE DRAWINGS

In the following the invention is illustrated by way of example with reference to the accompanying schematic drawings, in which.

DETAILED DESCRIPTION

Figure 1:
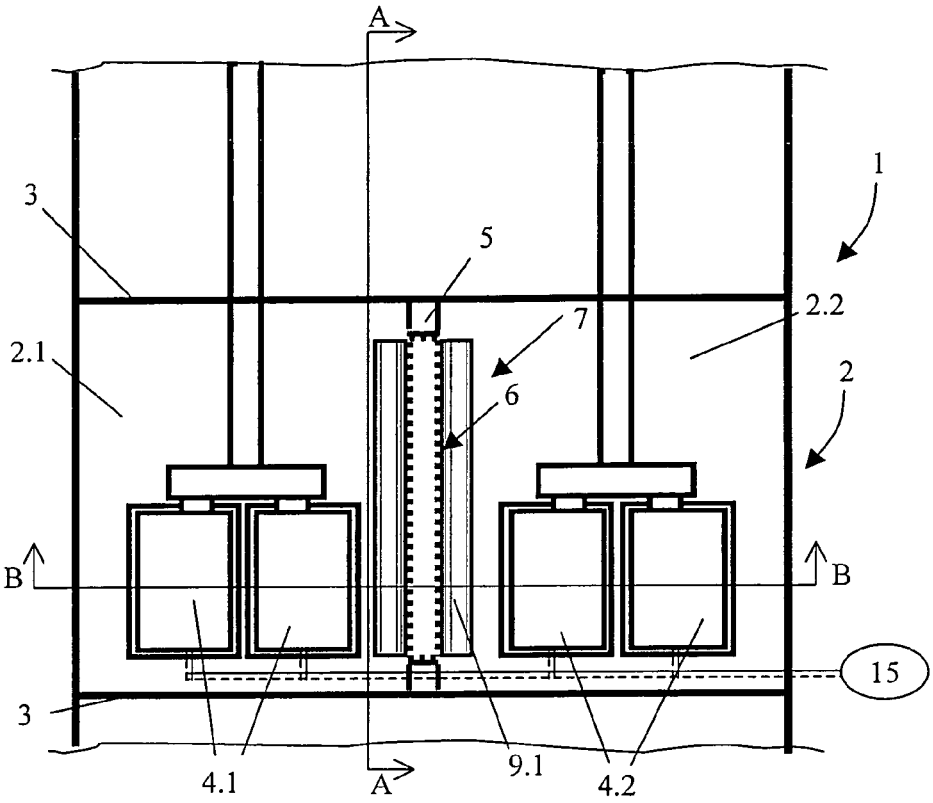
FIG. 1 shows a horizontal sectional view depicting the machine rooms of a ship provided with a floodgate arrangement embodying the invention.
Figure 2:
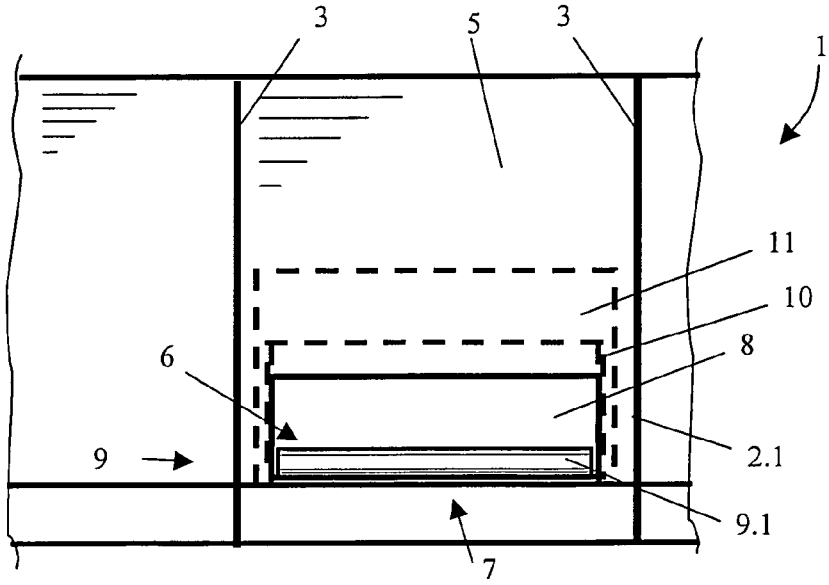
FIG. 2 shows a view taken on the line A—A of FIG. 1.

In FIGS. 1 and 2 there is schematically illustrated a part of a marine vessel 1, such as a ship. For sake of simplicity the stern and bow are not shown. The ship is provided with a machine room 2, which is bounded by transverse bulkheads 3. The machine room is divided by a longitudinal bulkhead 5 into two engine compartments 2.1, 2.2. Each compartment contains a pair of engines 4.1, 4.2, but there may be only one engine in each compartment. The engines are gas operated and are accordingly connected with a source of gas 15. The longitudinal bulkhead 5 dividing the engine room extends between the transverse bulkheads 3 substantially in a direction of vessel's center line, so that a solid wall structure is formed.

The solid wall structure of the longitudinal bulkhead 5 has different functions for different circumstances, and in order to fulfil its purposes, it has an opening 6, which is provided with a floodgate arrangement 7. The floodgate arrangement comprises a gate device 8, by means of which the opening 6 may be opened and closed. The main purposes of the longitudinal bulkhead, i.e. the solid wall structure, is to separate the engine compartments from each other, which is required by safety regulations e.g. when gas engines are used. Gas as the fuel poses an increased risk of explosion and therefore the separate compartments are necessary. Hence, the gate device 8 is constructed to prevent the pressure and other effects of a possible gas explosion in one compartment from causing damage in the other compartment. The longitudinal bulkhead is also substantially gas tight for separating the compartments in case of gas leakage.

The gate device 8 is supported by a gate support structure 10 adapted to prevent rotary movement of the gate device 8. In the embodiment of FIGS. 1 and 2, the gate device is located partially within the wall structure. This arrangement allows only translational movement of the gate device, in this case up and down in FIG. 2. In addition to being substantially explosion proof when closed, the floodgate arrangement comprises a buoyancy assisted movement actuation device 9, which is operated by hydrostatic pressure caused by leaking water. The buoyancy assisted movement actuation device 9 includes float means 9.1 attached directly to the two opposite sides of the gate device. This way in case of flood in one of the compartments 2.1, 2.2, the float means will raise the gate device and provide an opening for water to enter the other, adjacent compartment which equalizes the mass of the water over the beam of the ship. The float means 9.1 are naturally watertight. In this embodiment they are formed as elongated, hollow (gas filled) cylinder shaped parts attached to the lower section of the gate device 8.

Figure 3:
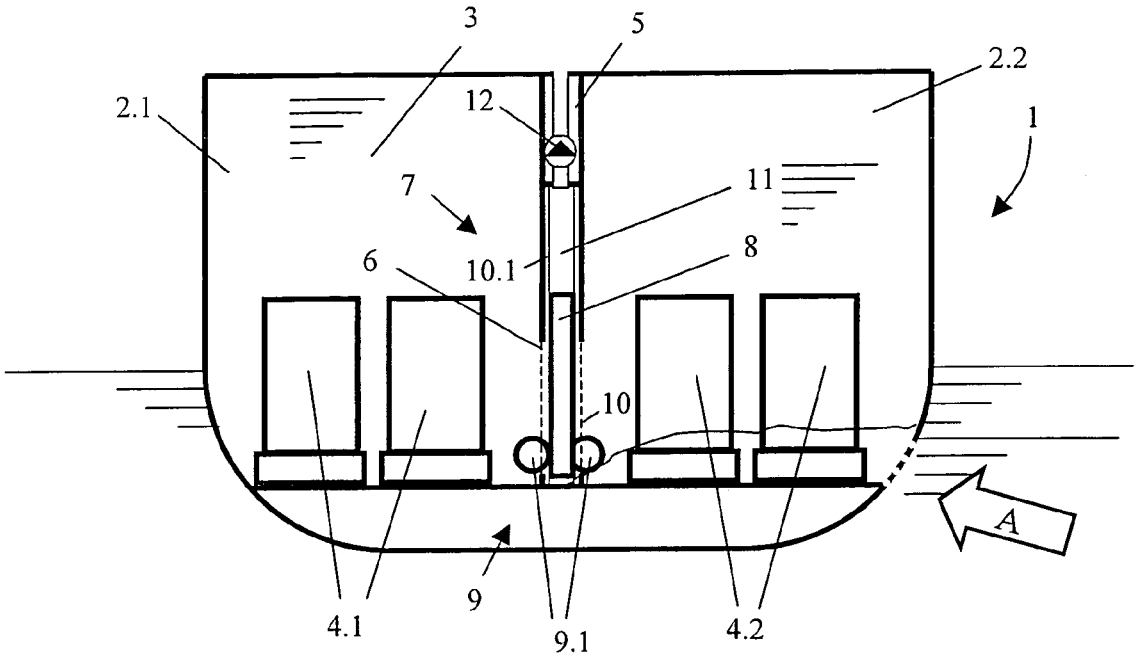
FIG. 3 shows a sectional view taken on the line B—B of FIG. 1 in a beginning stage of a leakage occurrence.
Figure 4:
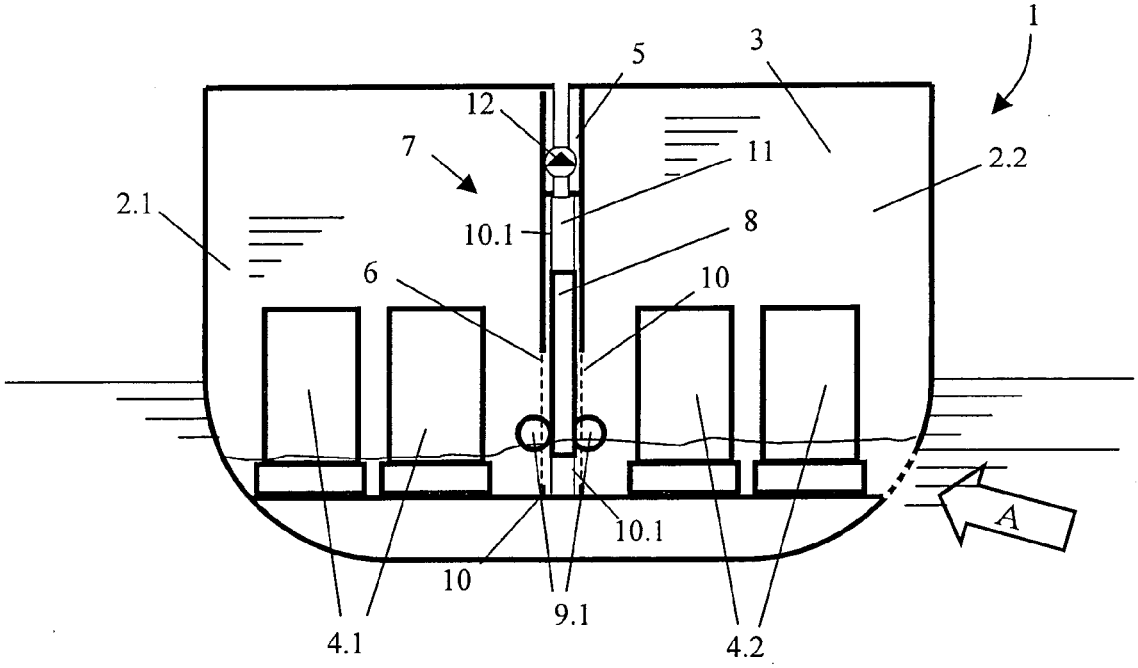
FIG. 4 shows a view similar to FIG. 3 at a later stage of the leakage occurrence.

Turning to FIGS. 3 and 4, one can see the operation of the arrangement when the hull of the vessel is leaking. The construction is corresponding to that of FIGS. 1 and 2 and corresponding reference numbering has been used. The arrow "A" shows a leakage at one side of the ship 1. When water enters the compartment 2.2, as is shown in FIG. 3, and its level is rising, normally the ship begins to list. However, as the water level in the compartment 2.2 rises, the float means 9.1 begin to exert force on the gate device 8. As can be seen in FIG. 4 the gate device begins to lift up and simultaneously increase the open area of the opening 6. In consequence of that, the water may enter the other, adjacent compartment 2.1. Since the water may enter the adjacent compartment 2.1, the weight of water is divided substantially equally between the two compartments and excessive listing of the ship is prevented.

The wall structure 5 comprises a space or pocket 11 into which the gate device 8 slides when it moves upwards in FIGS. 3 and 4. The wall structure 5 also comprises a gate support or guide structure 10, by means of which the gate device is supported by the wall structure so that only translational movement of the gate device is possible. In this embodiment the gate device is partially within the wall structure at both ends and the gate support structure additionally comprises gate device guides 10.1, which guide the movement of the gate device 8 and allow only vertical movement of the gate device. This arrangement provides a structure that prevents opening of the gate device by hydrodynamic pressure caused e.g. by explosion or a leakage water jet against the gate device but which opens the gate device when the water level is increasing, that is by hydrostatic pressure. Since the wall structure 5 is preferably gas tight, particularly when gas engines are used, the space 11 is connected to a pressure device 12, e.g. a blower or pump, to provide underpressure in the space 11 and prevent possible undesired drifting of gases from one compartment to the other.

As mentioned before, the buoyancy assisted movement actuation device 9 is directly attached to the gate device 8. Consequently, the construction is straightforward and reliable.

Figure 5:
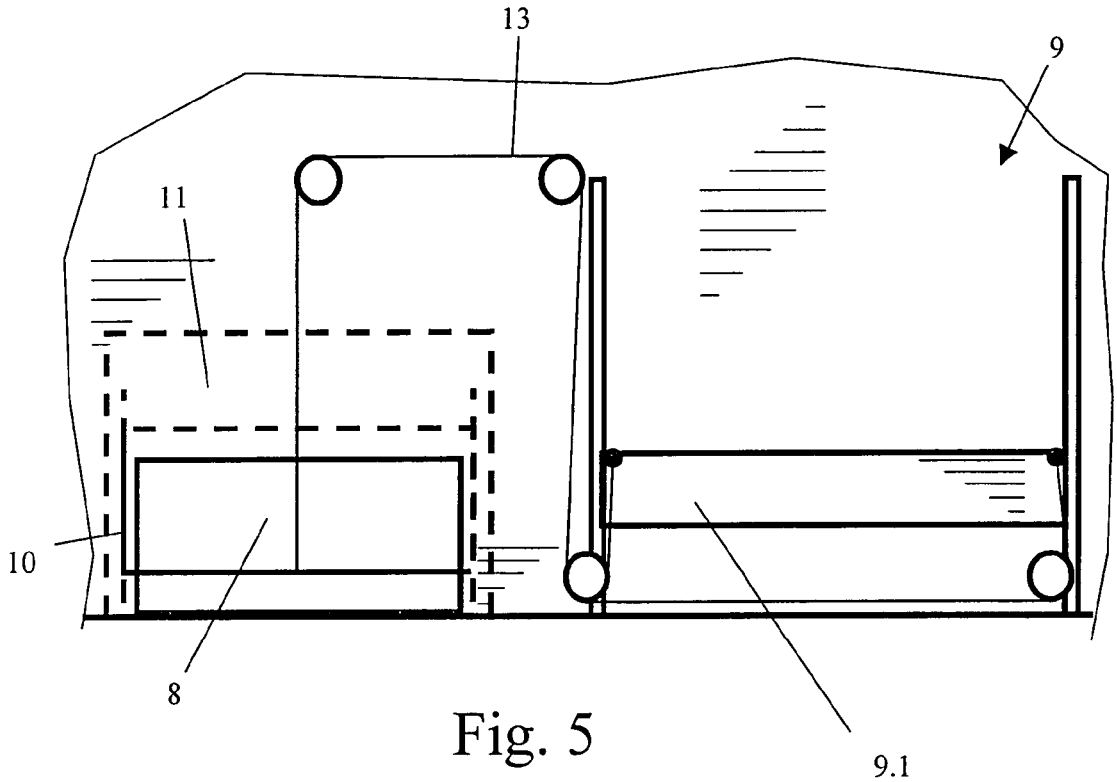
FIG. 5 shows another embodiment of the floodgate arrangement according to the invention.

In FIG. 5 is shown an embodiment in which the gate device 8 and the buoyancy assisted movement actuation device 9 are connected with each other by a force transmission means 13. The force transmission means is here a wire pulley arrangement, but it may also be e.g. a hydraulic arrangement.

The invention is not limited to the embodiments shown but several modifications may be conceivable within the scope of the claims. For example instead of one large floodgate arrangement it is possible to provide several smaller ones. The float means may also comprise automatically or manually inflatable construction.

The invention claimed is:

1. A marine vessel having at least two engines installed in separate respective engine compartments that are positioned substantially horizontally adjacent to each other and are separated from each other by a wall structure defining at least one opening provided with a floodgate arrangement, wherein the floodgate arrangement comprises a gate device that is movable between a closed position, in which the gate device blocks the opening, and an open position, in which the gate device frees the opening, and a buoyancy assisted movement actuation device for moving the gate device from its closed position to its open position under the influence of rising water level, and wherein the buoyancy assisted movement actuation device comprises a float that is directly attached to the gate device.

2. A marine vessel according to claim 1, wherein the wall structure comprises a gate support structure adapted to prevent rotational movement of the gate device relative to the gate support structure and to allow translational movement of the gate device relative to the gate support structure.

3. A marine vessel according to claim 2, wherein the gate support structure comprises gate device guides which allow only substantially vertical movement of the gate device.

4. A marine vessel according to claim 1, wherein the wall structure defines an interior space into which the gate device may be at least partially moved when moving from its closed position to its open position, and the floodgate arrangement comprises a pressure device for influencing pressure prevailing in the space.

5. A marine vessel according to claim 1, wherein the buoyancy assisted movement actuation device is connected to a lower section of the gate device.

6. A marine vessel according to claim 1, wherein the engines are gas operated.

7. A marine vessel having at least two engines installed in separate respective engine compartments that are positioned substantially horizontally adjacent to each other and are separated from each other by a wall structure defining at least one opening provided with a floodgate arrangement, wherein the floodgate arrangement comprises a gate device that is movable between a closed position, in which the gate device blocks the opening, and an open position, in which the gate device frees the opening, and a buoyancy assisted movement actuation device for moving the gate device from its closed position to its open position under the influence of rising water level, and wherein the buoyancy assisted movement actuation device comprises a float and a force transmission means coupling the float to the gate device.

8. A marine vessel according to claim 7, wherein the wall structure comprises a gate support structure adapted to prevent rotational movement of the gate device relative to the gate support structure and to allow translational movement of the gate device relative to the gate support structure.

9. A marine vessel according to claim 8, wherein the gate support structure comprises gate device guides which allow only substantially vertical movement of the gate device.

10. A marine vessel according to claim 7, wherein the wall structure defines an interior space into which the gate device may be at least partially moved when moving from its closed position to its open position, and the floodgate arrangement comprises a pressure device for influencing pressure prevailing in the space.

11. A marine vessel according to claim 7, wherein the buoyancy assisted movement actuation device is connected to a lower section of the gate device.

12. A marine vessel according to claim 7, wherein the engines are gas operated.

* * * * *